US006999098B2

(12) United States Patent
Leather

(10) Patent No.: US 6,999,098 B2
(45) Date of Patent: Feb. 14, 2006

(54) APPARATUS FOR CONVERTING FLOATING POINT VALUES TO GAMMA CORRECTED FIXED POINT VALUES

(75) Inventor: Mark M. Leather, Saratoga, CA (US)

(73) Assignee: ATI Technologies Inc., Markham (CA)

( * ) Notice: Subject to any disclaimer, the term of this patent is extended or adjusted under 35 U.S.C. 154(b) by 54 days.

(21) Appl. No.: 10/459,790

(22) Filed: Jun. 12, 2003

(65) Prior Publication Data

US 2004/0100475 A1 May 27, 2004

Related U.S. Application Data

(60) Provisional application No. 60/429,661, filed on Nov. 27, 2002.

(51) Int. Cl.
*G09G 5/02* (2006.01)

(52) U.S. Cl. ..... 345/600; 345/601; 345/605; 348/254; 348/674; 358/519; 382/167

(58) Field of Classification Search ..... 345/600, 345/601, 605; 348/254, 674; 358/519
See application file for complete search history.

(56) References Cited

U.S. PATENT DOCUMENTS 5,528,741 A * 6/1996 Lucas ..... 345/593
6,166,781 A * 12/2000 Kwak et al. ..... 348/674
6,304,300 B1 * 10/2001 Warren et al. ..... 348/674
6,545,672 B1 * 4/2003 Goyins ..... 345/204
6,633,343 B1 * 10/2003 Ito et al. ..... 348/674

* cited by examiner

*Primary Examiner*—Matthew C. Bella
*Assistant Examiner*—Antonio Caschera
(74) *Attorney, Agent, or Firm*—Vedder, Price, Kaufman & Kammholz, P.C.

(57) ABSTRACT

Graphics processing circuitry includes processing circuitry operative to generate pixel information in response to primitive information, and a correction circuit, coupled to the processing circuitry, operative to generate gamma corrected pixel information in response to the pixel information. The correction circuit converts the floating point pixel information generated by the processing circuitry into a gamma corrected fixed-point value so that gamma space pixel data is stored in the frame buffer. This fixed point gamma corrected pixel information, converted from the floating point pixel information, compensates for the non-linear display characteristics exhibited by current display devices. This results in the display output being more accurate; thereby, improving the appearance quality of the resulting image.

12 Claims, 3 Drawing Sheets

APPARATUS FOR CONVERTING FLOATING POINT VALUES TO GAMMA CORRECTED FIXED POINT VALUES

This application claims the benefit of U.S. Provisional Application Ser. No. 60/429,661 filed Nov. 27, 2002, entitled "Apparatus for Converting Floating Point Values to Gamma Corrected Fixed Point Values", having as inventor, Mark M. Leather, and owned by instant assignee.

FIELD OF THE INVENTION

The present invention generally relates to graphics processing circuits, such as graphics processors and, more particularly to an apparatus for providing gamma corrected fixed point pixel values.

BACKGROUND OF THE INVENTION

Modern graphics processors process input primitive (e.g. triangle) information in floating point format and generate corresponding output pixel information, where the accumulated pixel information represents a scene. The pixel information provided by the graphics processor is typically stored in a frame buffer, or other suitable memory, for subsequent transmission and presentation on a suitable display device. The pixel information is typically stored in the frame buffer in fixed point format. The display presents the pixel information in fixed point analog format, referred to as gamma space. In operation, the stored pixel (e.g. digital) information is passed through a digital-to-analog converter (DAC), before the pixel information is presented on the display.

Modern displays exhibit non-linear appearance characteristics which may be represented as follows:

$$b=V^{gamma}$$

where b represents, for example, a corresponding appearance (e.g. brightness) value of the display output, V represents the pixel value provided by the DAC and gamma represents a weighing factor associated with the pixel value. Thus, the appearance (e.g., brightness), for example, of a pixel to be presented on the display does not exhibit a one-to-one linear relationship with the signal (e.g. voltage) provided by the DAC. This results in inferior image quality, for example, as the actual pixel appearance (e.g. brightness) is typically less than expected based on the gamma value. For example, an input brightness value of 0.5 does not result in a displayed pixel brightness of ½max; rather, the resulting displayed brightness of the corresponding pixel is typically about ¼max.

One solution is to use an inverse gamma table located between the frame buffer and the digital-to-analog converter of a display controller. The inverse gamma table may be, for example, a look-up table that includes conversion values that effectively correct for the non-linear characteristics of the display device. However, a disadvantage of such a system may be that the frame buffer typically is only 8-bits per component per pixel and so for values near black there may be very discrete steps that are plainly visible on the monitor since the monitor is typically more sensitive to low light levels that to high light levels. In such systems gamma correction is performed after the pixel information is stored in the frame buffer.

BRIEF DESCRIPTION OF THE DRAWINGS

The present invention and the corresponding advantages and features provided thereby will be best appreciated and understood upon review of the following detailed description of the invention, taken in conjunction with the following drawings, where like elements represent like elements, in which.

DETAILED DESCRIPTION OF THE INVENTION

Briefly stated, graphics processing circuitry includes processing circuitry operative to generate pixel information in response to primitive information, and a correction circuit, coupled to the processing circuitry, operative to generate gamma corrected pixel information in response to the pixel information. The correction circuit converts the floating point pixel information generated by the processing circuitry into a gamma corrected fixed-point value so that gamma space pixel data is stored in the frame buffer. This fixed point gamma corrected pixel information, converted from the floating point pixel information, compensates for the non-linear display characteristics exhibited by current display devices. This results in the display output being more accurate; thereby, improving the appearance quality of the resulting image.

Figure 1:
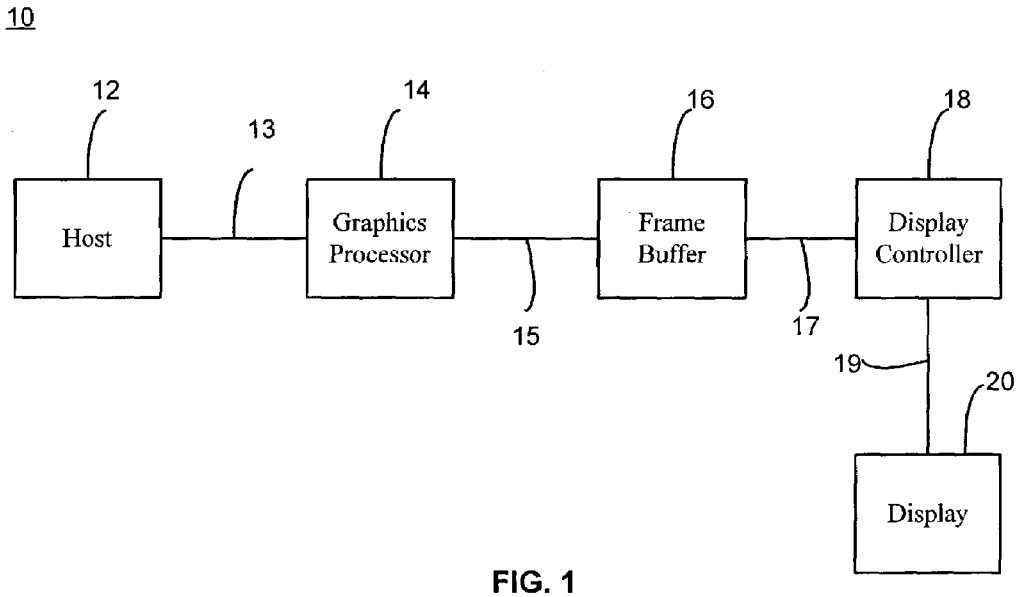
FIG. 1 PRIOR ART
FIG. 1 is a schematic block diagram of a conventional graphics processing and display system.

FIG. 1 is a schematic block diagram of a conventional graphics processing and display system. The graphics processing and display system 10 includes a host processor, for example, a processor or an application running a processor 12 that provides primitive data 13 to a graphics processing circuitry such as a graphics processor 14. The graphics processor 14 receives the primitive data 13 and generates corresponding pixel data 15, representing an appearance value (e.g. brightness) to be applied to a pixel before such pixel is presented on a display 20. The pixel data 15 is transmitted to a frame buffer 16, or other suitable memory, for storage. A display controller 18 is operative to retrieve the stored pixel data 17 from the frame buffer 16, convert the pixel data into an analog signal 19, for example, through a digital-to-analog circuit (DAC), and transmit the analog signal 19 for presentation on the display 20.

Figure 2:
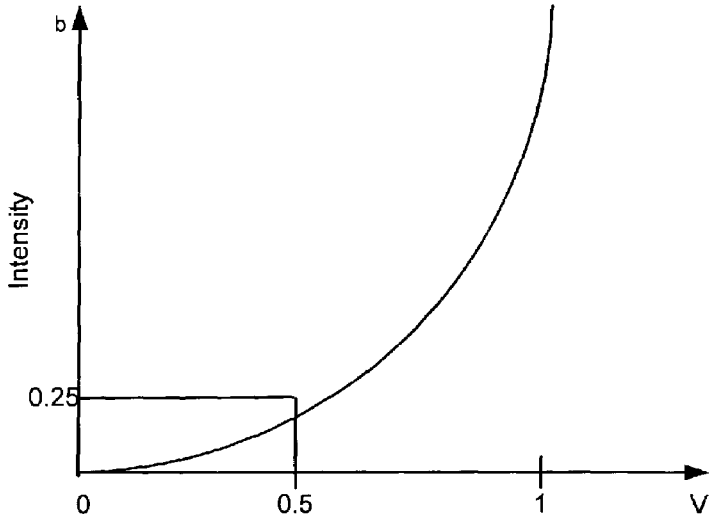
FIG. 2 PRIOR ART
FIG. 2 is a graph illustrating the non-linear display characteristics of the display associated with the graphics processing and display system illustrated in FIG. 1.

FIG. 2 is a graph illustrating the appearance (e.g. brightness intensity) characteristics of the display 20. As illustrated, the display 20 exhibits non-linear display (e.g. brightness) characteristics which may be represented as: $b=V^{gamma}$, where b represents the brightness of the display, V represents the value or magnitude of the analog signal 19 and gamma represents a weighing factor associated by the display, typically around 2.0. Thus, an input brightness value of about 0.5 will result in an output brightness value of about 0.25 the maximum brightness value. This results in inferior image quality, for example, as the actual pixel appearance (e.g. brightness) is typically less than expected based on the gamma value. The present invention overcomes the aforementioned and related drawbacks associated with displays by providing a fixed point gamma corrected pixel value in the frame buffer that compensates for the non-linear characteristics associated with displays. The fixed point gamma corrected value stored in frame buffer memory and subsequently provided to a suitable display device, thereby proves a more linear relationship between input value and output pixel appearance and accurate presentation of pixel information on the display.

Figure 3:
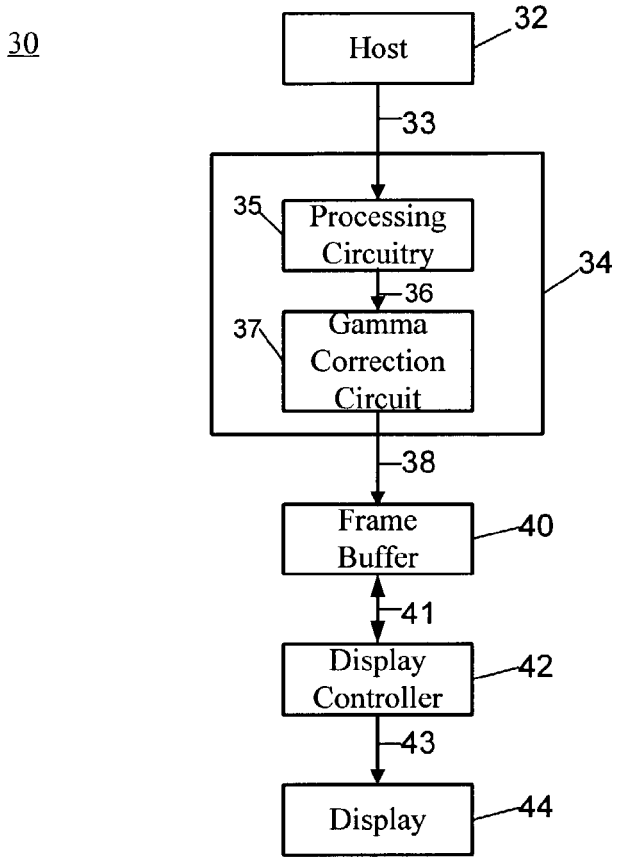
FIG. 3 is a schematic block diagram of an exemplary graphics processing system employing the gamma correction circuit according to the present invention.

FIG. 3 is a schematic block diagram of a graphics processing system 30, employing a graphics processing circuit 34 such as a graphics processor (e.g. graphics chip) that includes a gamma correction circuit 37 according to the present invention. A host processor 32 which may include a graphics software application executing on the host processor 32 such as a suitable driver, provides primitive information 33, as known in the art, to graphics processing circuitry 34. The graphics processing circuitry 34 may include, for example, a graphics processor chip or a plurality of integrated circuits as desired. The graphics processing circuitry 34 includes processing circuitry 35 and gamma correction circuit 37. The processing circuitry 35 generates floating point pixel information in response to the primitive information 33. The floating point pixel information is indicated as 36. The gamma correction circuit 37, is operatively coupled to receive the floating point pixel information 36 from the processing circuitry 35 and generates fixed point gamma corrected pixel information 38 for storage in frame buffer 40, in response to the floating point pixel information 33. The processing circuitry 35 includes, among other things, a rasterizer, shading circuitry, and blending circuitry which performs floating point operations on the incoming primitive information 33.

The frame buffer 40 receives the fixed point gamma corrected pixel information 38 from the gamma correction circuit 37 and stores the fixed point gamma corrected pixel information 38 for output to display 44. A display controller 42 operatively coupled to the frame buffer 40 and to the display 44, retrieves the stored fixed point gamma corrected pixel information 41 (i.e., stored 38) and displays the information as display information 43 for display 44. As such, the display controller 42 does not perform gamma correction. The display 44 can be a CRT, flat panel display, high definition television display, or any suitable display.

The gamma correction circuit 37 provides for a substantially linear relationship between input pixel values and display appearance (e.g. intensity) by compensating for the non-linear characteristics of the display 44 before the fixed point gamma corrected pixel information 38 is stored in the frame buffer 40. In application, the gamma correction circuit 37 determines the value, based on an inverse gamma curve, and combines the correction value to base integer data.

Figure 4:
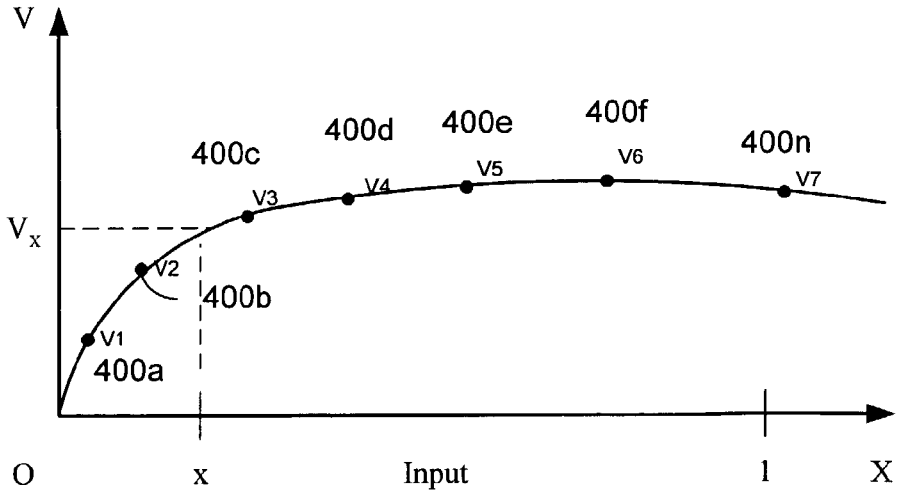
FIG. 4 is a graph illustrating the gamma correction curve provided by the gamma correction circuit illustrated in FIG. 3.

FIG. 4 is a graph illustrating a gamma correction curve (also referred to as an inverse gamma curve) which is in effect used by the gamma correction circuit 37 to generate the fixed point gamma corrected pixel information (i.e., values). Representations of the discrete points 400*a*–400*n* are stored in a look-up table as further described below.

Figure 5:
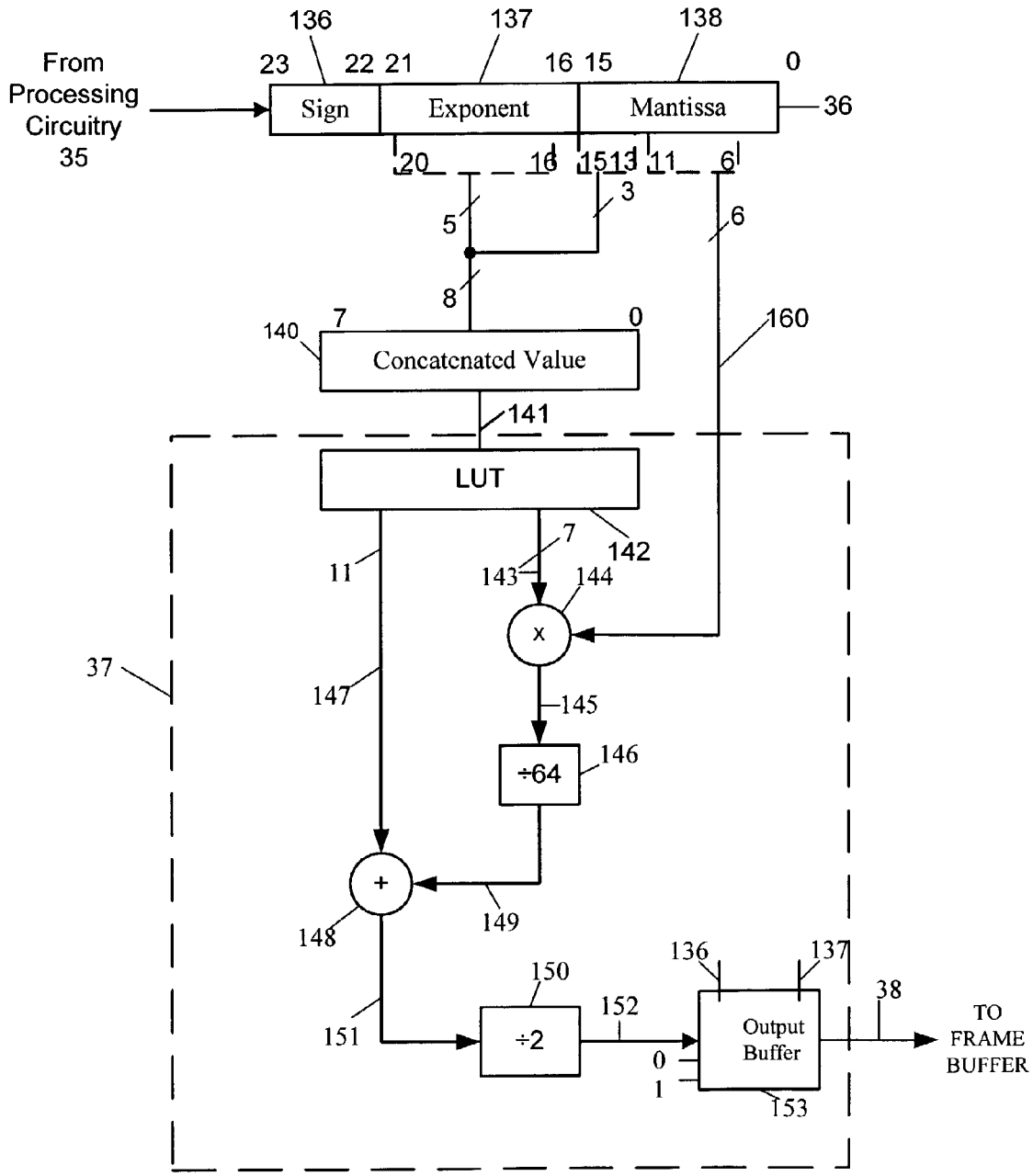
FIG. 5 is a schematic block diagram of an exemplary gamma correction circuit according to the present invention.

FIG. 5 is a schematic block diagram of an exemplary gamma correction circuit 37 according to one embodiment of the invention. The gamma correction circuit 37 approximates an inverse gamma value for any point along the inverse gamma curve (FIG. 4) by performing a linear interpolation between discrete points 400*a*–400*n* along the inverse gamma curve. The floating point pixel information 36, in this example, is represented as 24-bit data whereas the fixed point gamma corrected information 38 is represented as 10-bit data. Hence the floating point pixel information 36 represents a 24 bit floating value, including a 1-bit sign bit 136, a 6-bit exponent 137 and 16-bit mantissa 138. In application, bits [20:16] of the exponent 137 are concatenated with bits [15:13] of the mantissa 138 into an 8-bit concatenated value 141 that may be stored in a register 140. The concatenated value 141 is then used to address a corresponding look-up table 142, which contains the data representing discrete points of the inverse gamma curve illustrated in FIG. 4, such as points 400*a*–400*n*.

The look-up table 142 provides two outputs, base integer data 147, such an 11-bit output, which represents discrete integer values along the inverse gamma curve, and first input data 143, such as a 7-bit value, representing the difference between discrete integer values (e.g. points along the inverse gamma curve).

A multiplication circuit 144 is operably coupled to the look-up table 142 to receive first input data 143 and second input data 160, representing a mantissa portion of the floating point pixel information 36. Hence the 7-bit difference value, first input data 143, is provided as a first input to the multiplication circuit 144. The second input data to the multiplication circuit are bits [11:6] of the mantissa 138. The multiplication circuit 144 provides intermediate data 145 in response to the first input data and the second input data. The intermediate data 145 is provided as an input to a divider circuit 146.

The divider circuit 146 provides normalized intermediate data 149 in response to the intermediate data 145. In this example, the divider circuit 146 performs a divide by 64 operation, which is used to normalize or convert the mantissa bits [11:6] to a value between 0 and 1. The divider circuit 146 provides the intermediate data 149 as input to an addition circuit 148. The addition circuit 148 provides intermediate data 151 in response to the normalized intermediate data 149 and in response to the base integer data 147 wherein the base integer data represents a discrete value along a gamma correction curve. An output of the addition circuit 148 provides the intermediate data 151 to another divider circuit 150 which performs a divide by 2 operation. The divider circuit 150 is coupled to receive an output of the addition circuit 48, and provides the fixed point gamma corrected pixel information 152 in response to the intermediate data 151. Hence the output of the divider circuit 150 represents gamma corrected fixed point pixel information which has been compensated for the non-linear characteristics of a corresponding display device. An output buffer 153 is operably coupled to receive the fixed point gamma corrected pixel information 152, in this example, includes a 3 to 1 multiplexer and includes a plurality of inputs. One input may be hard wired to logical 0 or ground and another input may be hard wired to a logical 1, whereas the third input receives the fixed point gamma corrected pixel information 152. The output of the output buffer 153 is determined by the sign bit 136 of the floating point of a floating point pixel information 36 and the exponent 137 of a floating point pixel information 36 according to the table below:

| CONTROL SIGNALS | | |
|---|---|---|
| SIGN | EXPONENT | OUTPUT |
| 0 | ≥63 | 1 |
| 1 | ≤31 | 0 |
| 0 or 1 | 32–62 | Gamma corrected signal |

Thus, the output of the gamma corrections circuit 37 may be clipped to 0 or 1, depending upon the sign bit and the value of the exponent of the floating point pixel information 36. It will be recognized that the operations described herein may be implemented via any suitable structure including any suitable combination of hardware, software and firmware.

Stated another way, the gamma correction circuit operates based on the following gamma correction circuit equation.

GAMME CORRECTION CIRCUIT EQUATION $$V[int(x)]+(V[int(x)+1]-V[int(x)])*(x-int(x))$$

where V[int(x)] is the 11-bit output of the LUT 142 (FIG. 5) and represents the base input pixel value, (V[int(x)+1]−V[int(x)]) is the 7-bit output of the LUT 142 (FIG. 5) representing the difference between adjacent points (e.g. values) along the inverse gamma curve and (x−int(x)) is represented as bits[11:6] of the mantissa of the floating point pixel value. The value (V[int(x)+1]−V[int(x)])*(x−int(x)) is the correction value added to the base pixel value to compensate for the non-linear characteristics of the display before such pixel value is stored in the frame buffer.

The above detailed description of the invention and the examples described therein have been provided for the purposes of illustration and description. It is therefore contemplated that the present invention cover any and all modifications, variations and/or equivalents that fall within the spirit and scope of the basic underlying principles disclosed and claimed herein.

What is claimed is:

1. A graphics processing circuit, comprising:

processing circuitry operative to generate floating point pixel information in response to primitive information;

a gamma correction circuit, operatively coupled to receive the floating point pixel information from the processing circuitry, and operative to generate fixed point gamma corrected pixel information in response to the floating point pixel information;

a look up table for providing base integer data and first input data based on the floating point pixel information wherein the first input data represents a difference value associated with a point on a gamma correction curve;

a multiplication circuit operatively coupled to the look up table and operative to provide first intermediate data in response to the first input data and second input data representing a mantissa portion of the floating point pixel information;

a first divider circuit, operatively coupled to the multiplication circuit, and operative to provide normalized second intermediate data in response to the first intermediate data; and an addition circuit, operatively coupled to the first divider circuit, and operative to provide fixed point gamma corrected pixel information.

2. The graphics processing circuit of claim 1, further including a frame buffer, operatively coupled to the gamma correction circuit, that stores the fixed point gamma corrected pixel information for display.

3. The graphics processing circuit of claim 1, wherein the floating point pixel information is represented as 24-bit data and the fixed point gamma corrected pixel information is represented as 10-bit data.

4. A gamma correction circuit, comprising:

a multiplication circuit operative to provide first intermediate data in response to first input data representing a difference value associated with a point on a gamma correction curve and second input data representing a mantissa portion of floating point pixel information;

a first divider circuit, operatively coupled to the multiplication circuit, and operative to provide normalized second intermediate data in response to the first intermediate data;

an addition circuit, operatively coupled to the first divider circuit, and operative to provide third intermediate data in response to the normalized second intermediate data and base integer data representing a discreet value along a gamma correction curve; and a second divider circuit, coupled to the addition circuit, and operative to provide fixed point gamma corrected pixel information in response to the third intermediate data.

5. The gamma correction circuit of claim 4, further including a look up table for providing the base integer data and the first input data in response to a floating point pixel value.

6. The gamma correction circuit of claim 4, further including an output buffer, coupled to the second divider, operative to provide one of: the fixed point gamma corrected data and a clipped value to a frame buffer.

7. The gamma correction circuit of claim 6, wherein the output buffer provides the one of the fixed point gamma corrected data and the clipped value in response to a control signal.

8. The gamma correction circuit of claim 7, wherein the output buffer includes a multiplexer.

9. A graphics processor comprising:

processing circuitry operative to generate floating point pixel information in response to primitive information; and a gamma correction circuit, coupled to receive the floating point pixel information from the processing circuitry, and operative to generate fixed point gamma corrected pixel information in response to the floating point pixel information and further including:

a look up table for providing base integer data and first input data based on the floating point pixel information wherein the first input data represents a difference value associated with a point on a gamma correction curve;

a multiplication circuit operatively couple to the look up table and operative to provide first intermediate data in response to the first input data and second input data representing a mantissa portion of the floating point pixel information;

a first divider circuit, operatively coupled to the multiplication circuit, and operative to provide normalized second intermediate data in response to the first intermediate data;

an addition circuit, operatively coupled to the first divider circuit, and operative to provide third intermediate data in response to the normalized second intermediate data and base integer data representing a discreet value along a gamma correction curve;

a second divider circuit, coupled to the addition circuit, and operative to provide fixed point gamma corrected pixel information in response to the third intermediate data; and an output buffer, coupled to the second divider, operative to provide one of: the fixed point gamma corrected data and a clipped value to a frame buffer.

10. The graphics processor of claim 9, further including a frame buffer, operatively coupled to the gamma correction circuit, that stores the fixed point gamma corrected pixel information for display.

11. The graphics processor of claim 9, wherein the floating point pixel information is represented as 24-bit data and the fixed point gamma corrected pixel information is represented as 10-bit data.

12. A graphics processing circuit, comprising:

processing circuitry operative to generate floating point pixel information in response to primitive information;

a gamma correction circuit, operatively coupled to receive the floating point pixel information from the processing circuitry, and operative to generate fixed point gamma corrected pixel information in response to the floating point pixel information, comprising;

a look up table for providing base integer data and first input data based on the floating point pixel information wherein the first input data represents a difference value associated with a point on a gamma correction curve.

a multiplication circuit operatively coupled to the look up table and operative to provide first intermediate data in response to the first input data and second input data representing a mantissa portion of the floating point pixel information;

a first divider circuit, operatively coupled to the multiplication circuit, and operative to provide normalized second intermediate data in response to the first intermediate data;

an addition circuit, operatively coupled to the first divider circuit, and operative to provide third intermediate data in response to the normalized second intermediate data and base integer data representing a discreet value along a gamma correction curve; and a second divider circuit, coupled to the addition circuit, and operative to provide fixed point gamma corrected pixel information in response to the third intermediate data.

* * * * *